US006227892B1

(12) United States Patent
Kera

(10) Patent No.: US 6,227,892 B1
(45) Date of Patent: May 8, 2001

(54) SECUREMENT COLLAR FOR MARINE SHORE ELECTRICAL POWER CORD SET

(76) Inventor: David J. Kera, 9117 Copenhaver Dr., Potomac, MD (US) 20854

( * ) Notice: Subject to any disclaimer, the term of this patent is extended or adjusted under 35 U.S.C. 154(b) by 0 days.

(21) Appl. No.: 09/280,658

(22) Filed: Mar. 29, 1999

Related U.S. Application Data

(60) Provisional application No. 60/080,453, filed on Apr. 2, 1998.

(51) Int. Cl.[7] ..... H01R 13/62
(52) U.S. Cl. ..... 439/320
(58) Field of Search ..... 439/320, 312, 439/321, 296

(56) References Cited

U.S. PATENT DOCUMENTS 2,552,707 * 5/1951 Bird et al. ..... 439/320
5,082,454 * 1/1992 Tonkiss et al. ..... 439/320

* cited by examiner

*Primary Examiner*—Khiem Nguyen
(74) *Attorney, Agent, or Firm*—Breiner & Breiner

(57) ABSTRACT

A marine shore electrical power cord set has a plug end with an external elastic retention ring. A securement collar is mounted to the plug end and retained thereon by the external elastic retention ring. In one embodiment, the securement collar includes a first arcuate collar portion having screw thread segments and a radial shoulder segment, a second arcuate collar portion having screw thread segments and a radial shoulder segment, and a hinge joint for attaching the first and second arcuate collar portions to one another such that the collar portions form an annular collar retained on the power cord set by the elastic retention ring engaging an annular shoulder formed by said shoulder segments. In another embodiment, a band has a diameter adjustable between a diameter larger than an outer diameter of the elastic retention ring and a diameter smaller than the outer diameter of the elastic retention ring. Retaining elements mounted to the band retain the securement collar on the plug end when the band is retained on the plug end by the elastic retention ring.

14 Claims, 3 Drawing Sheets

SECUREMENT COLLAR FOR MARINE SHORE ELECTRICAL POWER CORD SET

This application claims benefit of provisional application 60/080,453, filed Apr. 2, 1998.

BACKGROUND OF THE INVENTION

1. Field of the Invention

The present invention relates to marine shore electrical power cord set. More particularly, it relates to securement collars for the plug ends of marine shore electrical power cord sets.

2. Description of the Related Art

Marine shore electrical power cord sets are well known. An example is the MARINECO electrical power connector manufactured by Marine Industries Company. Such cord sets typically have two or more plug ends which are intended to mate with cooperating marine electrical power inlet or receptacle on a boat or a shore power supply in order to supply electrical power to the boat. As such, they include high capacity electrical wiring, together with the necessary insulation.

Due to the stringent requirements for operation under difficult marine conditions, it is necessary to assure that the electrical connections are water tight and will not become inadvertently loosened, e.g., owing to movement of the boat. For this purpose, it has been known to provide securement collars which are typically in the form of a threaded ring but may also be rings having lugs for a bayonet connection, in order to secure the plug ends of the cord set to the mating connectors. For simplicity of description, the remainder of the description and the claims will refer to a threaded securement collar, which is to be interpreted as also including securement collars having lugs for bayonet type connections. Similarly, any further reference to screw threads is to be interpreted as including lugs for bayonet type connections.

For example, referring to FIGS. 1 and 2, which respectively show two plug ends of a conventional MARINECO power cord set, the power cord set and its plug ends 2 are covered by a heavy rubber waterproof insulation and have distal ends 4 of a circular section, which are sized and configured to fit into the inlet or receptacle connections of a boat or a shore power source. An elastic external rubber retention ring 6 is formed integrally with the insulation, and is spaced by an appropriate distance from the distal end 4 of the plug end 2.

The securement collar 8 is formed of a rigid material, e.g., a hard plastic, and has internal threads 10 designed to mate with external threads of the shore/boat connection, as well as a radially inwardly extending tapered shoulder 12. The inner diameter of the collar 8 is slightly larger than the outer diameter of the elastic retention ring 6, whereas the diameter of the inner lip 14 of the shoulder 12 is smaller than the outer diameter of the retention ring 6, so that the shoulder 12 and the retention ring 6 can cooperate to retain the collar 8 on the plug end 2. Accordingly, when the plug end 2 of the power connector is plugged into the cooperating inlet or receptacle of the boat or shore power supply, and the screw threads 10 are threaded with the cooperating screw threads of the boat or shore power supply inlet or receptacle, the radial shoulder 12 and retention ring 6 cooperate to assure a secure and waterproof connection.

On the other hand, there is no universal standard design for shore or boat power connections, and so the conventional securement collar 8 will not necessarily work with all shore or boat plug connections. The power cord set is therefore normally sold with the securement collar 8 dismounted from the plug end 2 thereof, and the securement collar 8 must be mounted to the plug end 2 when appropriate. This involves lubricating the plug end 2 and forcefully prying the tapered radial shoulder 12 over the retention ring 6, an operation which may be difficult to perform. Similarly, if the securement collar 8 is already mounted to the plug end 2, it must be pried off of the retention ring 6 when the power cord set is to be secured to a boat or shore power connector which is not compatible with the securement collar. Again, this requires forceful prying and is not easily done.

SUMMARY OF THE INVENTION

It is therefore an object of the invention to provide a securement collar for a marine shore electrical power cord set which is more easily applied to or removed from either plug end of the power cord set.

It is another object of the invention to provide a marine shore electrical power cord set having a securement collar which is more easily applied to or removed from either plug end of the power cord set.

According to an aspect of the invention, the above and other objects are achieved by a securement collar for a marine shore electrical power cord set having a plug end with an external elastic retention ring, comprising a first arcuate collar portion having screw thread segments and a radial shoulder segment; a second arcuate collar portion having screw thread segments and a radial shoulder segment; and means for attaching the first and second arcuate collar portions to one another such that the collar portions form an annular collar capable of being retained on the power cord set by the elastic retention ring engaging an annular shoulder formed by said shoulder segments.

BRIEF DESCRIPTION OF THE DRAWINGS

The invention can be better understood with reference to the attached drawings which illustrate non-limiting embodiments, and wherein.

DETAILED DESCRIPTION OF THE PREFERRED EMBODIMENT

Figure 1:
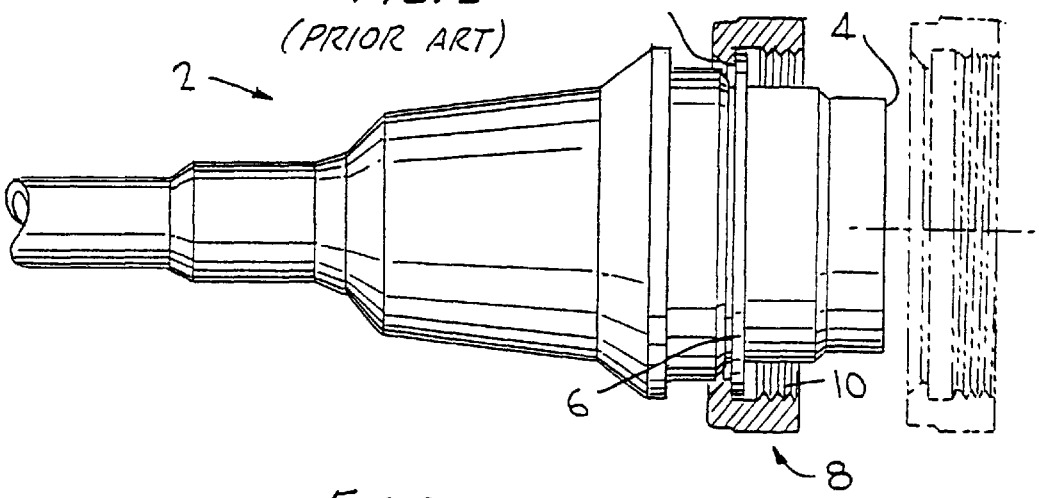
FIG. 1 (PRIOR ART)
FIG. 1 shows one example of a conventional plug end of a marine electrical power cord set.
Figure 2:
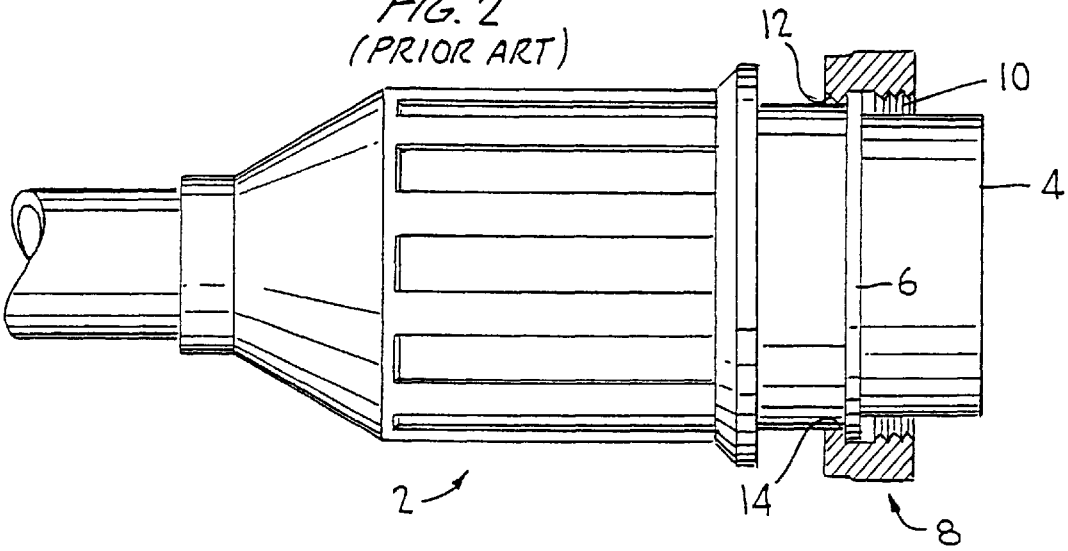
FIG. 2 (PRIOR ART)
FIG. 2 shows another example of a conventional plug end of a marine electrical power cord set.
Figure 3:
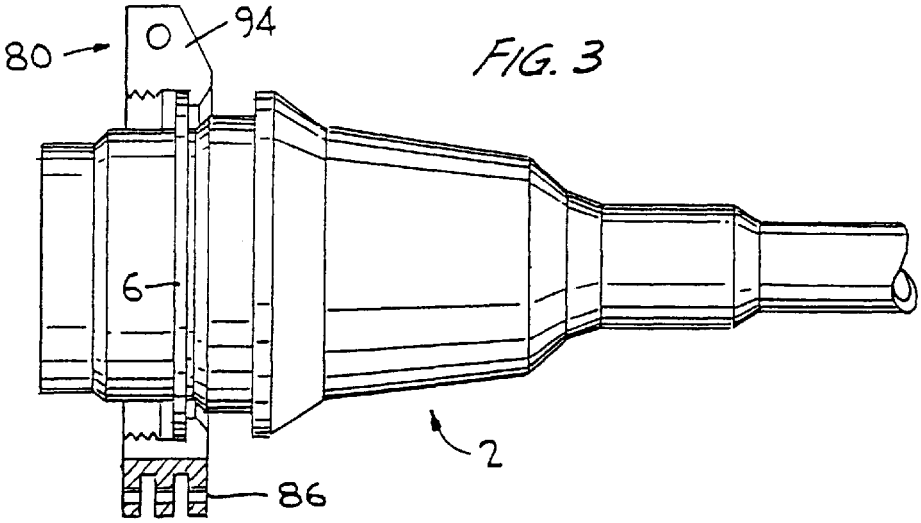
FIG. 3 shows a sectional view of a first embodiment of a securement collar according to the invention mounted to a conventional electrical power cord set.
Figure 4:
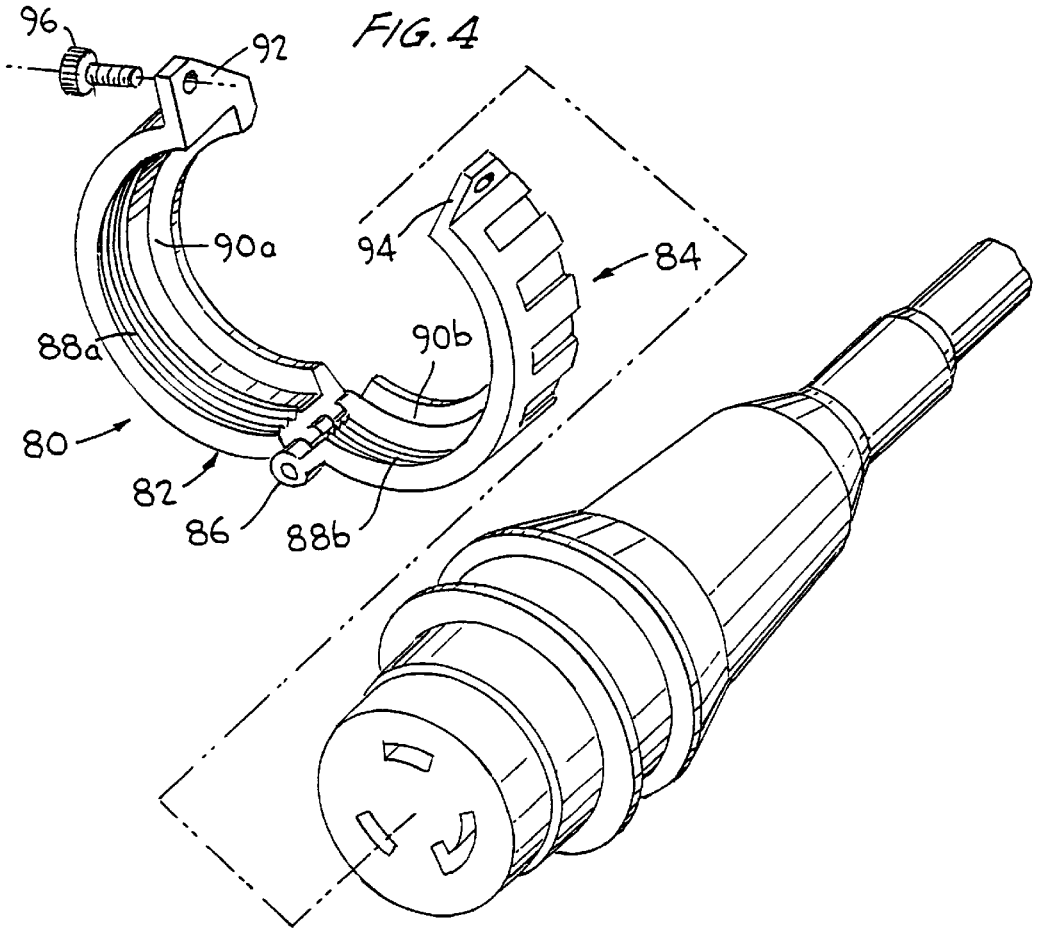
FIG. 4 is an exploded perspective view of the securement collar and plug end of FIG. 3.

Referring to the non-limiting first embodiment shown in FIGS. 3 and 4, the securement collar 80 essentially comprises a conventional securement collar 8 such as that shown in FIGS. 1 and 2, except that it is diametrically divided into two halves to form first and second arcuate collar portions 82 and 84 which are pivotally connected to one another at their first ends via a hinge joint 86. Each of the arcuate collar portions has screw thread segments 88*a* and 88*b*, as well as radial shoulder segments 90*a* and 90*b*.

Ends of the collar portions opposite the hinge 86 have flanges 92 and 94 including threaded holes through which a screw or bolt 96 can be inserted for retaining the first and second collar portions in a closed position. When in the closed position, the screw thread segments 88*a* and 88*b* together form a conventional screw thread such as that in the conventional securement collar, and the radial shoulder segments 90*a* and 90*b* together form a conventional annular radial shoulder such as that at 12 in FIGS. 1 and 2.

It may therefore be appreciated that the securement collar 80 of the invention may be mounted to the plug end 2 of a conventional power cord set by positioning the open collar portions 82 and 84 such that the radial shoulder segments are located behind the retention ring 6. The first and second collar portions can then be pivoted to a closed position in which the flanges 92 and 94 abut one another, and are securely held closed by the screw or bolt 96. In this case the retention ring 6 cooperates with the radial shoulder segments 90*a* and 90*b* to prevent the securement collar 80 from being removed from the plug end, in the same way as in the prior art. Removal of the securement collar can be performed by performing the above steps in reverse order.

It may be appreciated that the flange and screw arrangement 92–96 may be replaced by any other means for attaching the ends of the collar portions to one another. It may also be appreciated that the pivot joint 86 may be replaced by any other means for securing the first ends of the power portions to one another. For example, the pivot joint may be replaced by cooperating hooks which selectively hook the collar portions to one another but also permit the collar portions to completely separate from one another.

Figure 5:
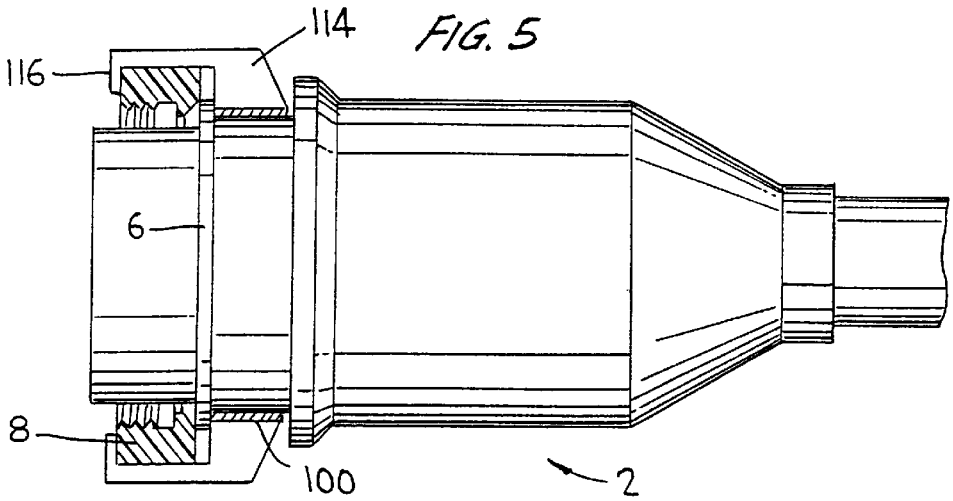
FIG. 5 is a view similar to that of FIG. 3, but showing a second embodiment of the invention.
Figure 6:
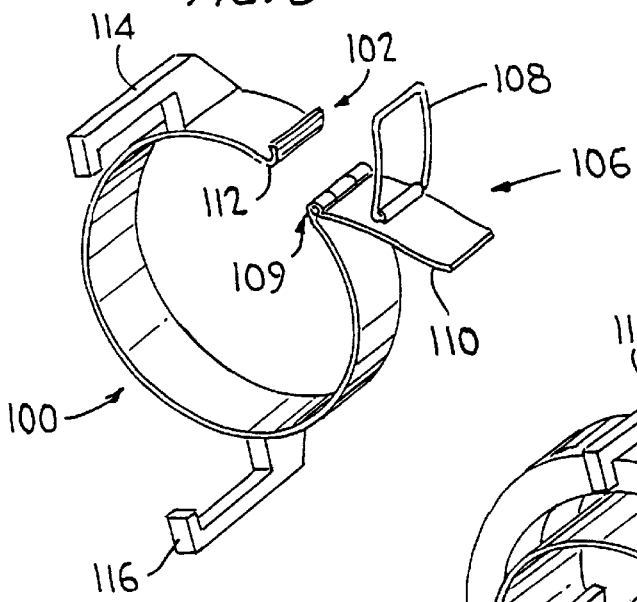
FIG. 6 is a perspective view of the securement collar according to the second embodiment.
Figure 7:
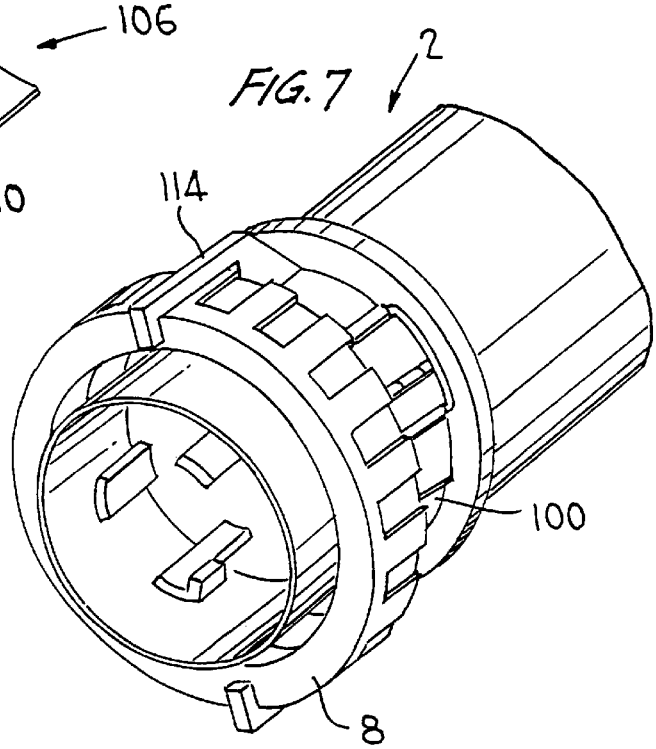
FIG. 7 is a perspective view showing the securement collar of the second embodiment mounted to the electrical cord set plug end.

Referring to the embodiment of FIGS. 5 through 7, an elastic band 100 may be formed of a resilient material such as spring steel and normally has an arcuate "C" shape with two facing ends 102 and 104. A latch mechanism 106 is able to connect the two facing ends in such a way as to draw the ends toward one another and thereby reduce the diameter of the elastic band 100, thereby forming a variable diameter ring element. For example, the latch mechanism 106 can comprise an over-center mechanism in which a first latch element in the form of a generally rectangular metal ring 108 is pivotally mounted to a mid-portion of a lever 110 which is in turn pivotally mounted to the end 104 of the band. The ring 108 is able to hook onto a hook portion 112 of the end 102 of the band. Accordingly, the latch mechanism can be operated to reduce the diameter of the band 100 by hooking the first latch number 108 onto the hook portion 112 and pivoting the lever 110 to an over-center position in which the end 102 is drawn toward the end 104. The latch mechanism 106 is then secured in the over-center position by the resilience of the band 100. Of course, it is to be understood that this particular latch mechanism is non-limiting and that other latch mechanisms capable of drawing the two ends of the elastic band 100 toward one another could instead be used.

Hooks 114 mounted to the external surface of the elastic band 100 have hooked ends 116 which hook over a conventional securement collar 8, as shown in FIGS. 5 and 7.

In use, the securement collar 8 is hooked by the hooks 114 while the latch mechanism 106 is unlatched. The unlatched band 100 and the securement collar 8 are then placed over the distal end of the plug end 2 with the securement collar abutting, but not passed over, the retention ring 6. The latch mechanism 106 is then latched to reduce the diameter of the band 100 such that it is less than the external diameter of the retention ring 6, and the band 100 securely fits onto the plug end 2 behind the retention ring 6. The retention ring 6 thereby prevents the band 100 from separating from the plug end 2, which in turn secures the securement collar 8 to the plug end via the hooks 114. Again, removal is performed by performing the above steps in reverse order.

Obviously, numerous modifications and variations of the present invention are possible in light of the above teachings. It is therefore to be understood that within the scope of the appended claims, the invention may be practiced otherwise than as specifically described herein.

What is claimed is:

1. A securement collar for a marine shore electrical power cord set having a plug end with an external elastic retention ring, comprising:

a first arcuate collar portion having screw thread segments and a radial shoulder segment;

a second arcuate collar portion having screw thread segments and a radial shoulder segment; and means for attaching the first and second arcuate collar portions to one another such that the collar portions form one annular collar capable of being retained on the power cord set by the elastic retention ring engaging an annular shoulder formed by said shoulder segments.

2. The securement collar of claim 1, wherein said attaching means comprise a hinge pivotally connecting first ends of said first and second collar portions.

3. The securement collar of claim 2, wherein said attaching means further comprise a screw connecting second ends of said first and second collar portions.

4. A securement collar for a marine shore electrical power cord set having a plug end with an external elastic retention ring, comprising:

a variable diameter ring element having an integral means for adjusting a diameter thereof so as to vary between a diameter larger than an outer diameter of the elastic retention ring and a diameter smaller than the outer diameter of the elastic retention ring, wherein said ring element is constructed and arranged to conform to a predetermined outer diameter of the plug end when the diameter of the ring element is adjusted from larger to smaller;

a securement collar ring having screw threads; and at least one retaining element mounted to said variable diameter ring element and capable of retaining said securement collar ring on the plug end of the power cord set when the variable diameter ring element is retained on the power cord set by the elastic retention ring.

5. The securement collar of claim 4, wherein said variable diameter ring element comprises:

an arcuate elastic band having two ends; and a latch mechanism at one of said two ends and engageable with the other of said two ends to draw the two ends toward one another and to thereby reduce the diameter of the variable diameter ring element.

6. The securement collar of claim 5, wherein said latch mechanism comprises an over-center mechanism.

7. The securement collar of claim 4, wherein said at least one retaining element comprises a plurality of hooks engageable with said securement collar ring.

8. A marine shore electrical power cord set comprising:

a plug end with an external elastic retention ring; and a securement collar mounted to said plug end and retained thereon by said external elastic retention ring, said securement collar comprising a first arcuate collar portion having screw thread segments and a radial shoulder segment, a second arcuate collar portion having screw thread segments and a radial shoulder segment, and means for attaching the first and second arcuate collar portions to one another such that the collar portions form one annular collar retained on the power cord set by the elastic retention ring engaging an annular shoulder formed by said shoulder segments.

9. The marine shore electrical power cord set of claim 8, wherein said attaching means comprise a hinge pivotally connecting first ends of said first and second collar portions.

10. The marine shore electrical power cord set of claim 9, wherein said attaching means further comprise a screw connecting second ends of said first and second collar portions.

11. A marine shore electrical power cord set comprising:

a plug end with an external elastic retention ring;

a variable diameter ring element having an integral means for adjusting a diameter thereof so as to vary between a diameter larger than an outer diameter of the elastic retention ring and a diameter smaller than the outer diameter of the elastic retention ring, wherein said ring element is constructed and arranged to conform to a predetermined outer diameter of the plug end when the diameter of the ring element is adjusted from larger to smaller;

a securement collar ring having screw threads; and at least one retaining element mounted to said variable diameter ring element and retaining said securement collar ring on the plug end when the variable diameter ring element is retained on the plug end by the elastic retention ring.

12. The marine shore electrical power cord set of claim 11, wherein said variable diameter ring element comprises:

an arcuate elastic band having two ends; and a latch mechanism at one of said two ends and engageable with the other of said two ends to draw the two ends toward one another and to thereby reduce the diameter of the variable diameter ring element.

13. The marine shore electrical power cord set of claim 12, wherein said latch mechanism comprises an over-center mechanism.

14. The marine shore electrical power cord set of claim 11, wherein said at least one retaining element comprises a plurality of hooks engageable with said securement collar ring.

* * * * *

UNITED STATES PATENT AND TRADEMARK OFFICE

CERTIFICATE OF CORRECTION

PATENT NO. : 6,227,892 B1
DATED : May 8, 2001
INVENTOR(S) : David J. Kera

It is certified that error appears in the above-identified patent and that said Letters Patent is hereby corrected as shown below:

Drawings,
Sheet 3 of 3, Figure 6, "109" should read -- 104 --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*